US005505347A

United States Patent [19]

Roma

[11] Patent Number: 5,505,347

[45] Date of Patent: Apr. 9, 1996

[54] POURING DEVICE

[76] Inventor: Sam Roma, 3065 Clayton St., Easton, Pa. 18042

[21] Appl. No.: 445,080

[22] Filed: May 19, 1995

[51] Int. Cl.[6] ..... B65D 25/48

[52] U.S. Cl. ..... 222/570; 222/573

[58] Field of Search ..... 222/566, 567, 222/569, 570, 573, 574

[56] References Cited

U.S. PATENT DOCUMENTS

| | | | |
|---|---|---|---|
| 401,432 | 4/1889 | Griswold | 222/573 |
| 453,081 | 5/1891 | Heimbaugh | 222/570 X |
| 3,031,112 | 4/1962 | Smith | 222/570 |
| 3,309,000 | 3/1967 | Haverstick | 222/569 |
| 3,596,813 | 8/1971 | Munn | 222/569 |
| 4,353,489 | 10/1982 | Arnold et al. | 222/570 |
| 4,949,884 | 8/1990 | Dahl | 222/570 X |
| 5,031,804 | 7/1991 | Conrad | 222/569 X |
| 5,392,969 | 2/1995 | Usery | 222/570 |

*Primary Examiner*—Kevin P. Shaver
*Attorney, Agent, or Firm*—John Lezdey

[57] ABSTRACT

The present invention relates to a new and improved apparatus for dispensing fluids for a container. The present invention can be easily attached and removed by, and can also remain firmly secured to the container even to withstand rough handling. The pouring attachment includes a spout hingedly attached to a tensioning device which is detachably secured to the top of a container, a housing containing a spring in communicative connection to a rod having a detachable retainer for attachment to the bottom of the container.

9 Claims, 2 Drawing Sheets

POURING DEVICE

BACKGROUND OF THE INVENTION

1. Field of the Invention

This invention relates to dispensing means and is particularly directed to detachable spouts for liquid containers which may be securely attached and readily detached.

2. Description of the Prior Art

It has been long known in the prior art that to facilitate the dispensing of liquids and to avoid spillage where fluids are dispensed or transferred from one container to another various intermediate devices have been employed. In pouring fluids from containers, it is difficult to maintain a confined flow of fluid from the lip of the container, particularly with buckets or cans with circular shapes. The situation becomes more aggravated if the container has rim channels, such as paint cans, since it precludes controlled pouring of the fluid. Various types of funnels and spouts have been known to the art for attachment to such containers to overcome these difficulties. However, these devices have not proved satisfactory because they do not fit securely on the container and lack any seal between the spouts and the container lip to prevent leakage. Furthermore, the pouring of the liquid from the container must be done carefully to prevent spilling or an overflow of the liquid around the sides of the spout or lid.

Exemplary of the prior art U.S. Pat. No. 3,221,955 entitled "Paint Can Protective Attachment", issued Dec. 7, 1965 discloses an attachment to be snap fit into the annular rim portion. The attachment has a dished top surface including a pouring spout comprising: an annular skirt depending from the rim portion and an annular flange depending from the underside of the rim portion and an annular flange also depending from the underside of the rim portion spaced inwardly from the depending annular skirt to define a groove adapted to receive the outer edge of the brim of the paint can. The structure of the ridge is designed to tightly engage the edge to prevent paint from entering and accumulating in the depressed portion of the can rim.

U.S. Pat. No. 3,853,249 entitled "Pouring Spout for Cans", issued Dec. 10, 1974 describes a pouring spout for paint cans and similar receptacles including a channel structure of resilient material that can be sprung into snug engagement with the rim of the paint can and curved lip element extending outwardly from the channel structure. The reusable pouring spout can be removed from the can by squeezing the resilient channel structure.

U.S. Pat. No. 4,203,537 entitled "Paint Can Accessory" issued May 20, 1980 is directed to a removable paint can accessory including an annular ring to cover the rim channel of a conventional paint can having a pouring spout. The pouring spout has a flat bottom and a leveraging means depending from the pouring spout permits force to be applied along the annular ring to remove the accessory from the can.

U.S. Pat. No. 4,269,890 entitled "Paint Can Collar", issued Jan. 25, 1983 relates to an attachment comprising a circular body having a lower lip portion projecting outwardly and upwardly from the intermediate portion such that spilled paint will return into the paint can. The lower lip portion further includes a plurality of tabs to maintain the paint can collar in engagement with the inner rim of the paint can. The upper lip portion may also include a pair of bisymmetrical indentations so that the handle of the paint can may be moved into a functional position for carrying the paint can without removing the paint collar.

U.S. Pat No. 4,911,319 entitled "Paint Can Attachment", issued Mar. 27, 1990 relates to a paint can attachment which fits into the rim channel around the open top of a paint can. A sloped ring shaped surface extends slightly into the can from getting into the rim channel. A spout attachment is included for guiding and pouring the liquid. Optionally, a paint scraper bar may be attached for scraping excess paint of the brushes. In most cans, the prior art container pouring attachments are friction fit, as noted in the above mentioned patents. The snap-on or friction fit attachments have a tendency to fall off resulting in spills and waste. Rough handling of the container such as might occur at the job site requires a more secure.

Therefore, it can be appreciated that there exists a continuing need for an improved funnel or spout attachment which can be firmly but detachably secured to a container. In view of the foregoing disadvantages inherent in the known types of paint can and similar container attachments now available in the prior art, the present invention provides an improved detachable pouring attachment for fluid containers.

SUMMARY OF THE INVENTION

In accordance with this invention there is provided an apparatus for dispensing fluids from a container comprising a spout attached to a tensioning device which spout is detachably secured to the top end portion of the container, a housing containing tensioning means in communicating connection to a rod having detachably securing means for attachment to the bottom of the container. The present invention provides a pouring attachment for a container which remains firmly secured even during rough service. The apparatus of this invention can be modified to fit any size shape container, e.g., from a paint can to a barrel or drum by using the rod component of the proper length. The type of spout depends on the design of the container rim and on the fluid transferred. These fluent materials may range from liquids, semi-liquids, semi-solids, and solids.

It is a primary object of this invention to provide a novel type of apparatus for dispensing fluids efficiently from a container which is designed for convenient attachment, quick detachment, and is firmly secured to the container.

Another object of this invention is to provide a detachable pouring apparatus which is firmly attachable to a container merely by securing the top securing means and the bottom securing means and which remains securely affixed to the container even in rough service.

Yet another object of this invention is to provide a detachable pouring apparatus for dispensing fluid with means provided for forming a fluid-tight seal between the apparatus and said container.

A further object of this invention is to provide a pouring apparatus for dispensing liquid from containers having a peripheral channel around the circumference of the container, which avoids filling said channel with liquid and spilling over the sides of said container during a pouring operation.

Still a further object of this invention is to provide a new and improved pouring apparatus for a paint can which prevents spilling or overflowing of the liquid.

Other and further objects of this invention will be apparent from the drawings and the following detailed description thereof which is set forth for the purpose of explaining the invention and is not regarded as necessarily limiting the scope of the invention, which is defined in the appended claims.

DETAILED DESCRIPTION OF THE PREFERRED EMBODIMENTS

Figure 1:
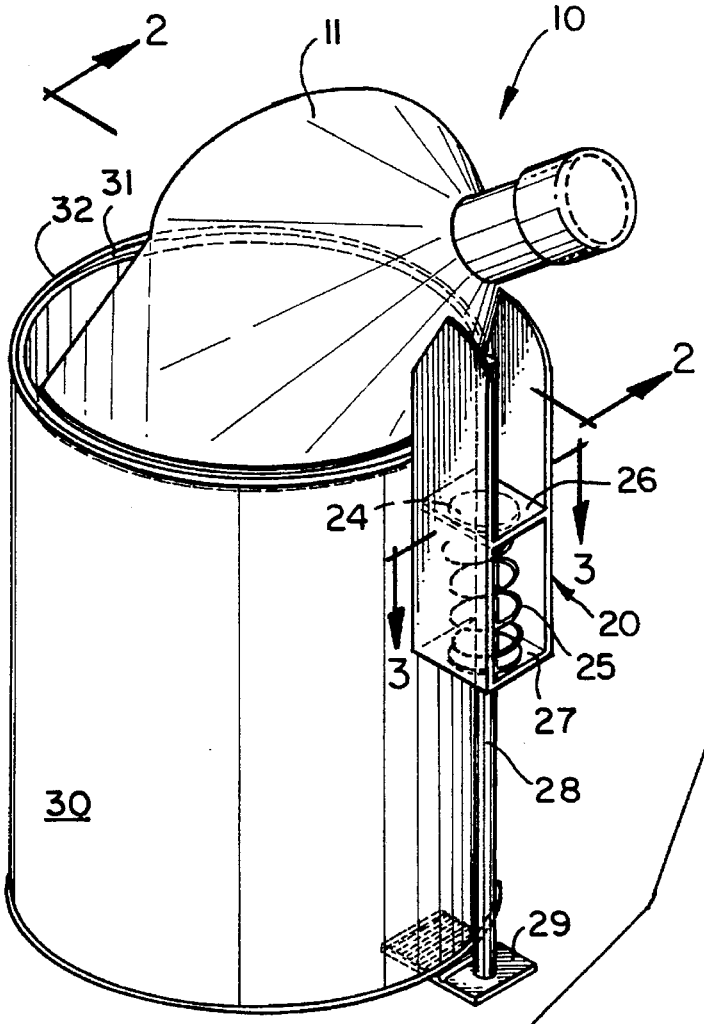
FIG. 1 is an elevated plan view of the detachable apparatus for dispensing fluids according to the present invention shown in place on a paint can.

Referring now to the drawings and in particular to FIG. 1, a preferred embodiment of the new and improved detachable apparatus for dispensing fluids from a container embodying the principle and concepts of the present invention and generally designated by the reference numeral 10 will be described.

In a preferred embodiment FIG. 1 shows a new and improved detachable apparatus for dispensing fluids in a secured position attached to a conventional paint can 30. Note in particular FIGS. 1 through 3. The apparatus 10 comprises a spout assembly 11 in combination with a tensioning device 20. The spout assembly 11 comprises a retainer element that engages circumferential groove 31 and 32 on the top of the paint can 30 and rim 33 at the bottom. The apparatus 10 may be made of metal or plastic. The spout assembly 11 in FIG. 1 is somewhat funnel shaped, i.e., having one large end suitable to receive fluid and one smaller end suitable for dispensing fluids and a bottom circular portion extending from the back of the spout to protrusions (not shown) to form a retainer element. Each protrusion is designed to frictionally fit circumferential grooves 31 and 32 to the spout assembly 11 of the can 30 and to provide an efficient seal for preventing fluid from entering the groove and flowing down the side of paint can 30. If metal is the material of construction may be the spout assembly 11 connected to a tensioning device 20 by welding means.

In an another embodiment of the invention, the spout assembly 11 maintains all the features described above, but is molded from a plastic material in a one piece construction.

Figure 4:
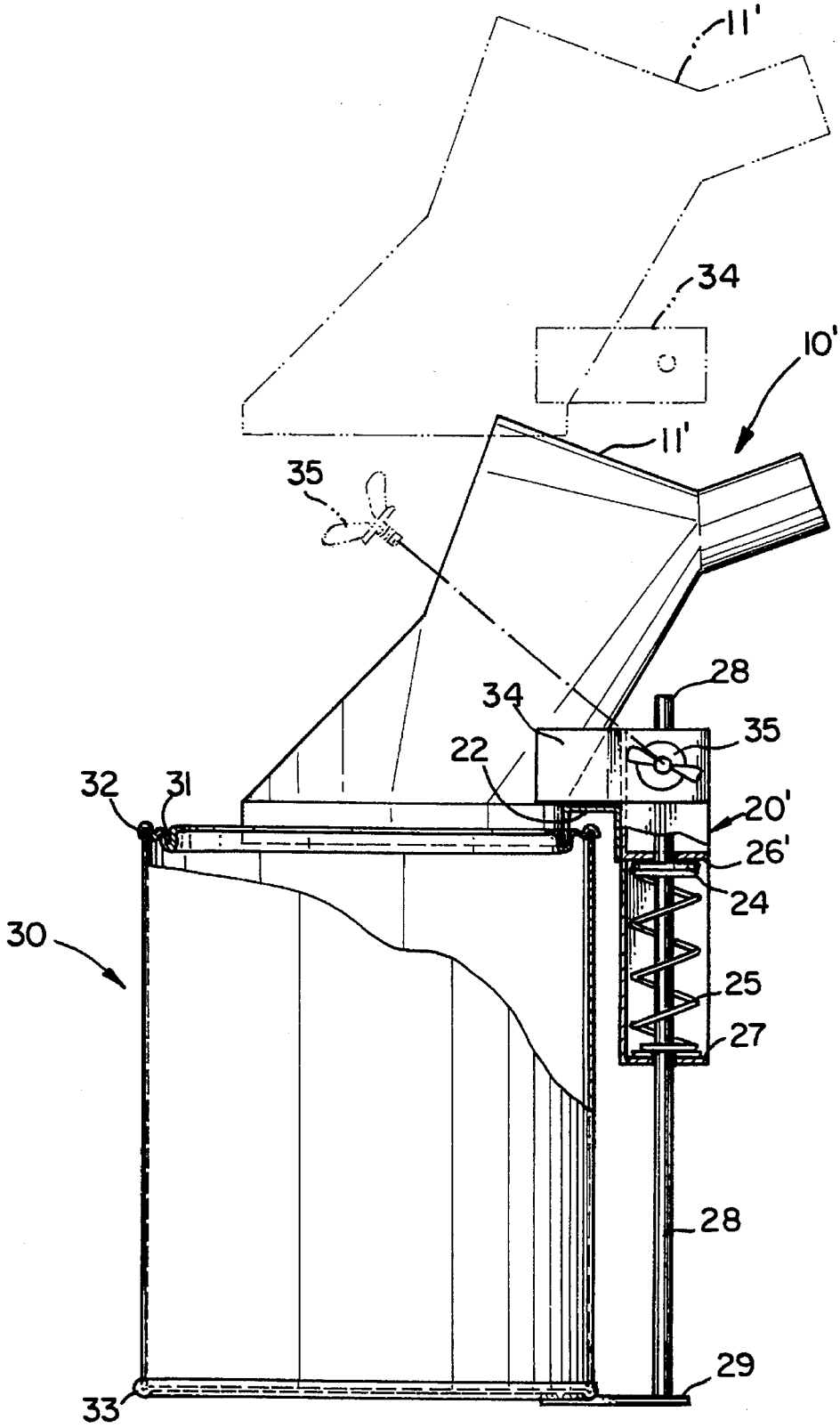
FIG. 4 is a cross-sectional view of another embodiment according to the present invention showing a detachable pouring spout assembly including a further elevated detached pouring spout assembly in ghost illustration.

In another embodiment a detachable pour spout 11' such as shown in FIG. 4 may be made of light metal or plastic and includes 14 including subtending protrusions (not shown) for snap fitting.

The critical feature of the present invention is the tensioning assembly 20 which includes a biasing means such as spring 25 to secure firmly the fluid dispensing attachment to container 30. As shown in FIG. 1 tensioning assembly 20 comprises housing 27 which is preferably constructed of a molded plastic or metal such as aluminum or steel. Housing 27 comprises upper retainer element 26, washer 24 and spring 25. Spring 25 is cooperativety connected by welding or mechanical means such as a bolt or pin to one end of rod 28. Rod 28 terminates in gripping means 29 which engages the edge or rim 33 on the bottom of can 30. Further, rod 28 should be of a length to exert sufficient force on spring 25 to secure firmly the apparatus 10 to container 30.

The biasing means 25 should provide sufficient tension along the longitudinal axis of the rod to provide a firm attachment of the apparatus of the present invention to the top and bottom of the container. The tension required would vary depending on the size of the container and the length of the rod. Biasing means may include springs, elastic polymers, turnbuckles, and similar tensioning devices. Specific tensioning devices include helical springs, rubber belts or bands, and the like.

Figure 2:
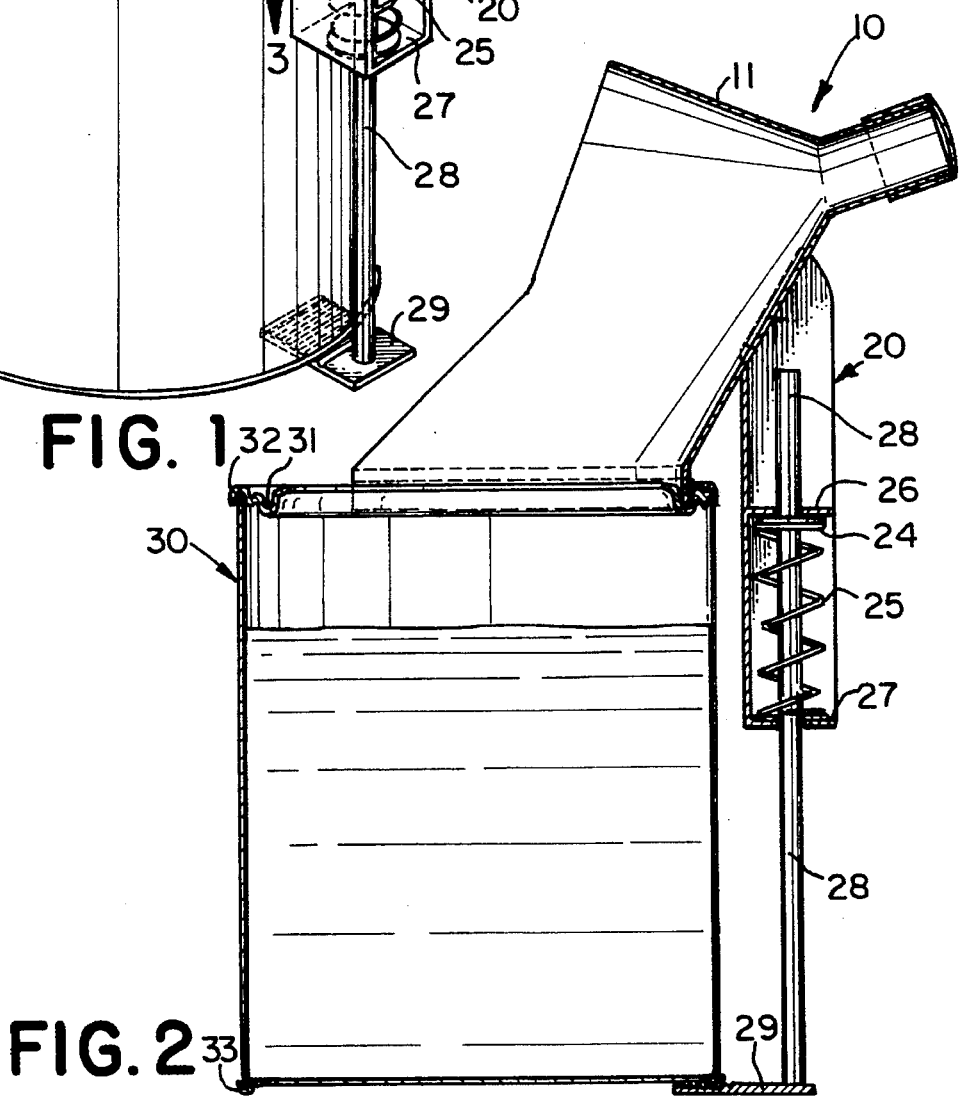
FIG. 2 shows an elevated side view of FIG. 1.

The rod 28 may be of various lengths to accommodate containers ranging from paint cans to large barrels. The rod 28 may be fixed or detachable to the tensioning means at the end of the rod and the other end terminates into a gripping means 29. As shown in FIGS. 1, 2 and 4, the gripping means 29 is a grooved foot attached to rod 28. Such attachment may be by mechanical means, e.g. bolts or pins or by welding. However, the gripping means may be integral with the rod by simply bending the rod to form a flattened hook (not shown) which can grip the bottom rim 33.

Figure 3:
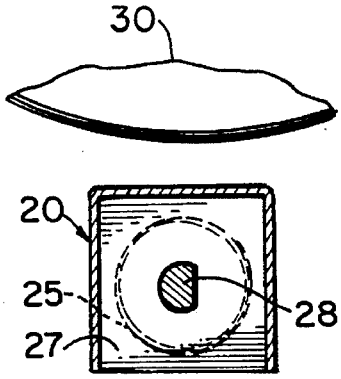
FIG. 3 illustrates a cross-sectional top view of the tensioning device along plane 3—3.

As shown in FIG. 3 which is a top view of the housing 20 along line 3—3 rod 28 has a flat portion which travels within the housing and this configuration prevents the rod from rotating. Alternatively, limiting spacer washers can also be used to limit the rotation of the rod. Preferably, the rod 28 is made from a metal such as steel, aluminum or molded plastic.

FIG. 4 illustrates another preferred embodiment of the present invention showing a detachable pouring spout having hinge plate 34 which is attached by a wing nut 35 to housing 20. Any type of mechanical attachment may be used including a friction fit attachment to secure the pouring spout 11 to the can 30.

As mentioned hereinbefore, the design of the pouring spout 11 is not limited to that illustrated in FIG. 4. The pouring spout 11 may be manufactured from paper to metal and plastic.

In use, the apparatus for dispensing a fluid can be mounted on the paint can 30 as shown in FIGS. 1 through 4 by press fitting the funnel assembly 11 in the circumferential grooves 31 and 32 of can 30. The apparatus 10 is further secured by extending the rod 28 end then allowing the rod to spring back to engage the bottom rim 33 of can 30 securing the apparatus 10 to the can 30. The user merely tips the can 30 when preparing to pour, permitting the contents to flow through the pour spout 11. The configuration of the pour spout prevents liquid from entering into the groove 21 and flowing down the outside of the can 30.

The apparatus 10 of the invention as shown in FIGS. 1–4 affords the user the ability to stir the liquid without removing or adjusting the apparatus. Further, for storage purposes, the apparatus 10 can accommodate the can lid (not shown) without removal or adjustment.

When the job is complete, it is a simple matter to remove the attachment and quickly clean it with the proper solvent.

While a paint can has been illustrated and described in the present disclosure, the apparatus of this invention can be modified to accommodate any container having a top and a bottom raised rim with a slight modification of the spout component to conform to the rim of the container. Sizes of container may range from paint cans to fifty-five gallon drums.

The apparatus of the present invention is useful for transferring fluids including liquids, semi-liquids, semi-solids, and solids.

With respect to the above description then, it is to be realized that the optimum dimensional relationships for the parts of the invention, to include variations in size, materials, shape, form, function, and manner of operation assembly and use are deemed readily apparent and obvious to one skilled in the art, and all equivalent relationships to those illustrated in the drawings and described in the specification are intended to be encompassed by the present invention.

Although the invention has been described with reference to particular embodiments, it is understood that these embodiments are merely illustrative of the applications of the principles of the invention. Numerous modifications may be devised without departing from the true spirit and scope of the invention, as set forth in the appended claims.

What is claimed is:

1. An apparatus for dispensing fluids comprising:

a spout means for pouring liquid connected to a tensioning device for securing said spout means to a fluid container, said tensioning device comprising an upper retainer element connected to said spout means, a housing containing a biasing element, said biasing element cooperatively connected to a rod, and said rod having a lower retainer element for attachment to the lower rim of said container.

2. The apparatus of claim 1 wherein said spout comprises a lateral portion having subtending protrusions designed to fit a container having circumferential grooves.

3. The apparatus of claim 1 wherein the lower retainer element is a hook integral with said rod.

4. The apparatus of claim 1 wherein said rod is of integral construction with said spout means.

5. The apparatus of claim 1 wherein said spout means is a funnel having one large end suitable to receive fluids and one smaller end suitable to dispense fluids wherein said retainer element is located at the bottom of said large end.

6. The apparatus of claim 1 wherein said retainer element is integral with said tensioning device.

7. The apparatus of claim 1 wherein said spout means is detachable.

8. The apparatus of claim 7 wherein said spout means is constructed of material selected from paper, plastic or metal.

9. The apparatus of claim 1 wherein said spout means and said tensioning device is made from plastic or metal.

* * * * *